US007227138B2

(12) United States Patent
Lee et al.

(10) Patent No.: US 7,227,138 B2
(45) Date of Patent: Jun. 5, 2007

(54) VIRTUAL ION TRAP

(75) Inventors: Edgar D. Lee, Highland, UT (US); Alan L. Rockwood, Provo, UT (US); Randall Waite, Springville, UT (US); Stephen A. Lammert, Glenburn, ME (US); Milton L. Lee, Pleasant Grove, UT (US)

(73) Assignee: Brigham Young University, Provo, UT (US)

( * ) Notice: Subject to any disclaimer, the term of this patent is extended or adjusted under 35 U.S.C. 154(b) by 179 days.

(21) Appl. No.: 10/878,989

(22) Filed: Jun. 28, 2004

(65) Prior Publication Data

US 2005/0040327 A1 Feb. 24, 2005

Related U.S. Application Data

(60) Provisional application No. 60/482,915, filed on Jun. 27, 2003.

(51) Int. Cl.
*H01J 49/00* (2006.01)

(52) U.S. Cl. ..... 250/292; 250/288; 250/291; 250/290; 250/283; 250/282

(58) Field of Classification Search ..... None
See application file for complete search history.

(56) References Cited

U.S. PATENT DOCUMENTS 4,931,640 A 6/1990 Marshall et al.
5,420,425 A 5/1995 Bier et al.
2003/0020012 A1 1/2003 Guevremont
2003/0038235 A1 2/2003 Guevremont et al.
2003/0089846 A1 5/2003 Cooks et al.
2003/0089847 A1 5/2003 Guevremont et al.

FOREIGN PATENT DOCUMENTS

WO WO 01/69217 A2 9/2001

OTHER PUBLICATIONS

D. A. Church, Storage-Ring Trap Derived from the Linear Quadrupole Radio-Frequency Mass Filter, Journal of Applied Physics, Jul. 1969, pp. 3127-3134, vol. 40—No. 8, Seattle, Wasington.
Randy W. Purves et al., Mass spectrometric characterization of a high-field asymmetric waveform ion mobility spectrometer, Review of Scientific Instruments, Dec. 1998, pp. 4094-4105, vol. 69—No. 12.
Rand W. Purves et al., Eletrospray Ionization High-Field Asymmetric Waveform Ion Mobility Spectrometry—Mass Spectrometry, Analytical Chemistry, Jul. 1, 1999, pp. 2346-2357, vol. 71—No. 13.

(Continued)

*Primary Examiner*—Nikita Wells
*Assistant Examiner*—Zia R. Hashmi
(74) *Attorney, Agent, or Firm*—Morriss O'Bryant Compagni

(57) ABSTRACT

A virtual ion trap that uses electric focusing fields instead of machined metal electrodes that normally surround the trapping volume, wherein two opposing surfaces include a plurality of uniquely designed and coated electrodes, and wherein the electrodes can be disposed on the two opposing surfaces using plating techniques that enable much higher tolerances to be met than existing machining techniques.

24 Claims, 9 Drawing Sheets

OTHER PUBLICATIONS

Roger Guevremont et al., Atmospheric pressure ion focusing in a high-field asymmetric waveform ion mobility spectrometer, Review of Scientific Instruments, Feb. 1999, pp. 1370-1383, vol. 70—No. 2.

Roger Guevremont et al., Ion trapping at atmospheric pressure (760 Torr) and room temperature with a high-field asymmetric waveform ion mobility spectrometer, Journal, Jul. 1999, pp. 45-56, Canada.

Roger Guevremont et al., Analysis of a Tryptic Digest of Pig Hemoglobin Using ESI-FAIMS-MS, Analytical Chemistry, Oct. 1, 2000, pp. 4577-4584, vol. 72—No. 19, Canada.

Roger Guevremont et al., Calculation of ion mobility from electrospray ionization high-field asymmetric waveform ion mobility spectrometry mass spectrometry, Journal of Chemical Physics, Jun. 15, 2001, pp. 10270-10277, vol. 114—No. 23.

Stephen A. Lammert et al., Design, Optimization and initial performance of a toroidal rf ion trap mass spectrometer, International Journal of Mass Spectrometry, Jul. 30, 2001, pp. 25-40.

Amy M. Tabert et al., High-Throughput Miniature Cylindrical Ion Trap Array Mass Spectrometer, Analytical Chemistry, Nov. 1, 2003, pp. 5656-5664, vol. 75—No. 21.

Stephen A. Lammert et al., Improved Performance Obtained On The Toroid Ion Trap Mass Analyzer Using Asymmetric Electrodes, 1998, Oak Ridge, Tennessee.

VIRTUAL ION TRAP

CROSS REFERENCE TO RELATED APPLICATIONS

This document claims priority to and incorporates by reference all of the subject matter included in the provisional patent application Ser. No. 60/482,915 and filed on Jun. 27, 2003.

BACKGROUND OF THE INVENTION

1. Field of the Invention

This invention relates generally to storage, separation and analysis of ions according to mass-to-charge ratios of charged particles and charged particles derived from atoms, molecules, particles, sub-atomic particles and ions. More specifically, the present invention is a device for performing mass spectrometry using a virtual ion trap, wherein the aspect of being virtual is in reference to the elimination of electrodes to thereby remove physical obstructions that result in more open access to a trapping volume.

2. Description of Related Art

Mass spectrometry (MS) is one of the most important techniques used by analytical chemists for identifying and quantifying trace levels of chemical elements and compounds in environmental and biological samples. Accordingly, MS can be performed as an independent process. However, MS becomes more powerful when coupled to separation techniques such as gas chromatography, liquid chromatography, capillary electrophoresis, and ion mobility spectrometry.

In MS, ions are separated according to their mass-to-charge ratios in various fields, including magnetic, electric, and quadrupole. One type of quadrupole mass spectrometer is an ion trap. Several variations of ion trap mass spectrometers have been developed for analyzing ions. These devices include hyperbolic configurations, as well as Paul, dynamic Penning, and dynamic Kingdon traps. In all of these devices, ions are collected and held in a trap by an oscillating electric field. Changes in the properties of the oscillating electric field, such as amplitude, frequency, superposition of an AC or DC field and other methods can be used to cause the ions to be selectively ejected from the trap to a detector according to the mass-to-charge ratios of the ions.

Mass spectrometers are mainly classified by reference to a mass analyzer that is used. These mass analyzers included magnetic and electric sector, ion cyclotron resonance (ICR), quadrupole, time-of-flight (TOF), and radio frequency (RF) ion trap.

Each of these mass analyzers has its own advantages and disadvantages. For example, sector and ICR instruments are known for their high mass resolution, TOF for its speed, and quadrupoles and ion traps for their simplicity and small size. ICR and sector instruments are typically large and complex to operate, and as with TOF, require high vacuum, while quadrupoles and ion traps operate at higher pressures, but deliver lower mass resolution. Most analytical problems can be solved using lower performance instruments. Therefore, quadrupole and ion trap mass spectrometers, that are significantly less expensive, are used ubiquitously in the industry.

A mass spectrometer is comprised of an ion source that prepares ions for analysis, an analyzer that separates the ions according to their mass-to-charge ratios, and a detector that amplifies the ion signals for recording and storage by a data system.

It was noted above that one particular advantage of ion trap mass spectrometers is that these devices typically do not require as high a vacuum within which to operate as other types of mass spectrometers. In fact, the performance of the ion trap mass spectrometer can be improved due to collisional dampening effects due to the background gas that is present. Ion trap mass spectrometers typically operate best at pressures in the mTorr range.

It is also observed that the smaller the ion trap, the higher the possible operating pressure. This is an important advantage for portable and handheld instruments, not only because of the reduced size of the ion trap, the electronics and power requirements, but also because of the reduced size of the vacuum pump that must be used.

It is important to also note that there has been considerable interest in reducing the size of ion trap mass spectrometers for portable and handheld use. Disadvantageously, a major problem with reducing the size of the ion trap is that machining tolerances become more critical at small sizes while trying to retain good ion trap resolution. One example of a small ion trap was reported by a research group at Oak Ridge. The device is basically a miniaturized version of a cylindrical ion trap with no real changes in the structure, but just the size.

It is also noted that the capacity for trapping ions is another issue when dealing with a small ion trap because of the issue of space-charge repulsion of particles within the trap.

Accordingly, what is needed is an ion trap that can be easily miniaturized without compromising resolution of the MS, provide easier access to the trapping volume, maximize space within a trapping volume, and meet manufacturing tolerances more easily than prior art machining techniques.

BRIEF SUMMARY OF THE INVENTION

It is an object of the present invention to provide a virtual ion trap that provides easier access to the trapping volume.

It is another object to provide a virtual ion trap that can be manufactured more easily than existing machining techniques.

It is another object to provide a virtual ion trap that can be miniaturized without sacrificing resolution of the MS.

In a preferred embodiment, the present invention is a virtual ion trap that uses electric focusing fields instead of machined metal electrodes that normally surround the trapping volume, wherein two opposing plates include a plurality of uniquely designed and coated electrodes, and wherein the electrodes can be disposed on the two opposing plates using photolithography techniques that enable much higher tolerances to be met than existing machining techniques.

In a first aspect of the invention, a plurality of electrodes generating electrical fields are disposed on two opposing plates to thereby create a trapping volume.

In a second aspect of the invention, a trapping field can be modified by changing the applied voltages to the plurality of electrodes, changing the number of electrodes, changing the orientation of the electrodes, and changing the shape of the electrodes.

In a third aspect of the invention, a plurality of trapping volumes can be created within a single ion trap using the plurality of electrodes described above.

In a fourth aspect of the invention, virtual ion trap arrays can be created that are massively parallel or in series.

In a fifth aspect of the invention, the virtual ion trap can electronically correct imperfections in the electric potential field lines that are generated to create the trapping volumes.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Figure 1:
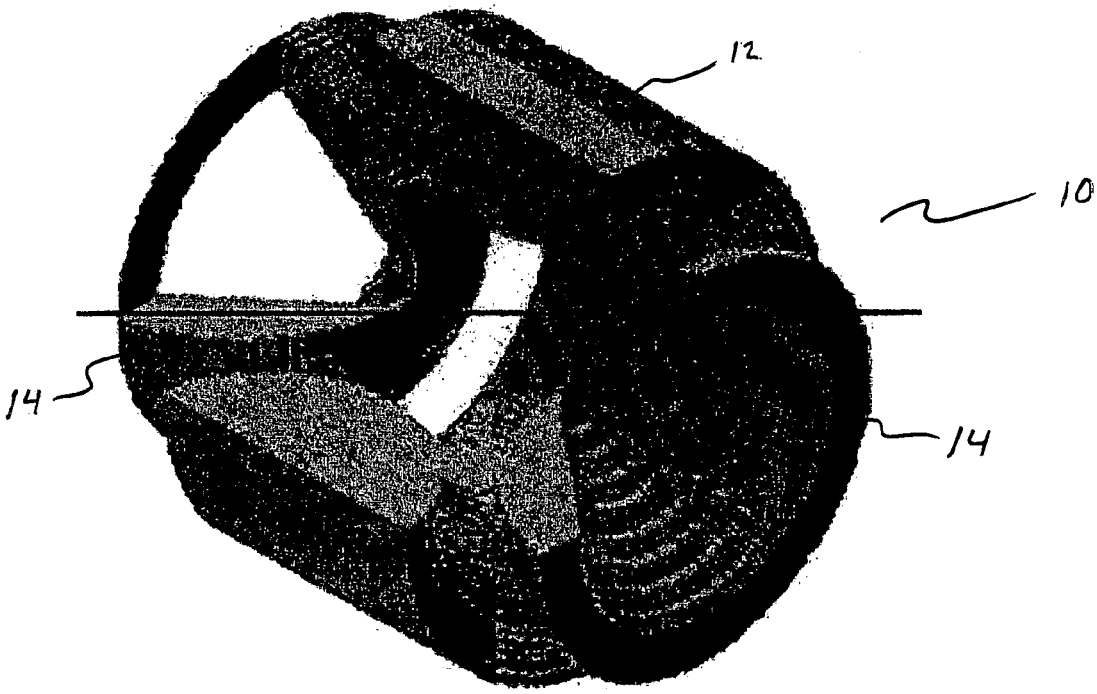
FIGURE 1 PRIOR ART
FIG. 1 is a perspective view of a prior art ion trap that is known to those skilled in the art.

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

It is important to understand several important issues from the outset of the description of the present invention. First, it should be understood that there is no single preferred embodiment, but rather various embodiments having different advantages. No assumptions should be implied as to the best embodiment from the order in which they are described.

Second, the present invention is a virtual ion trap that is typically used in conjunction with a mass spectrometer that is typically used to perform trapping, separation, and analysis of various particles including charged particles and charged particles derived from atoms, molecules, particles, sub-atomic particles and ions. For brevity, all of these particles are referred to throughout this document as ions.

The present invention can first be described in terms of its functions. Specifically, the present invention is an ion trap for use in a mass spectrometer, but instead of using machined metal electrodes that surround trapped ions, electric focusing fields are generated from electrodes disposed on generally planar, parallel and opposing surfaces. The term "virtual" thus applies to the fact that the confining walls of electrodes are replaced with the "virtual" walls created by the electric focusing fields.

The detailed descriptions thus briefly begins by describing some of the better known ion traps as known to those skilled in the art. Consider FIG. 1 which is a perspective view of a typical ion trap of the prior art. The prior art ion trap 10 is comprised of a metal ring electrode 12 and two metal end caps 14. The metal ring electrode 12 is equatorially centered. More simplified geometries for ion traps can be found in the prior art such as a simple cylinder ring electrode with solid flat or grid end caps, thereby forming a cylindrical ion trap. Another form of a trap is a linear ion trap. The trapping field is formed using four or more solid metal rods arranged around a central axis, with electrostatic ends caps disposed at each end of the rods. A toroidal ion trap and the cyclical linear trap are similar to a linear quadrupole, but with the electrode rods bent into a circle. This configuration eliminates the need for endcaps. Ions are trapped within the annular space between the four circular rods. Additional ion traps that are known to those skilled in the art include RF and DC Kingdon, DC orbitron, and DC linear, among others. It is noted that traps based only on DC fields require that the ions have significant kinetic energies and defined trajectories. The DC-only traps do not operate in the presence of a buffer gas (i.e., a low vacuum) because buffer gas dampens the trajectories of the ions.

What is important to understand from the prior art is that the electrodes used to create the trapping volume are creating substantial barriers, by themselves, to the flow of ions, photons, electrons, particles, and atomic or molecular gases into and emissions out of the ion traps.

Figure 2:
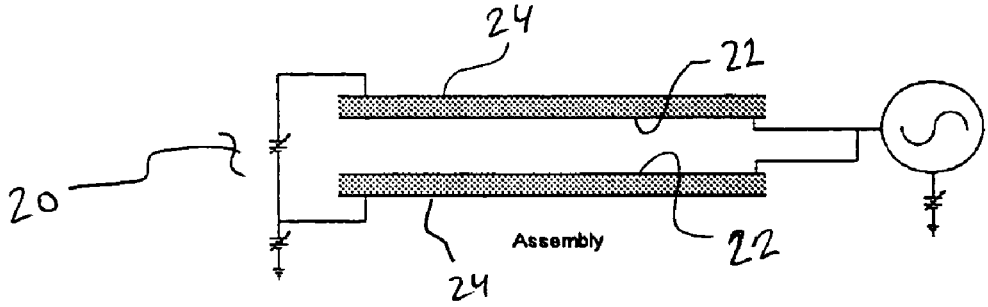
FIG. 2 is an edge view of a first embodiment that is made in accordance with the principles of the present invention.

FIG. 2 is provided as a typical but by no means simplest form of a virtual ion trap 20 that is made in accordance with the principles of the present invention. However, this edge view of the first embodiment demonstrates several important principles of the invention that are common to all embodiments of the invention to be described hereinafter.

First, some solid physical electrode surfaces of linear RF quadrupoles and other prior art ion traps are eliminated in favor of virtual electrodes. The virtual electrodes are formed by arranging a series of one or more electrodes on these opposing faces 22 that generate constant potential surfaces similar to the solid physical surfaces that the electrodes replace.

Second, the opposing faces 22 are aligned so as to be mirror images of each other.

Third, the opposing faces 22 are substantially parallel to each other.

Fourth, the opposing faces 22 are substantially planar. However, it is mentioned that the opposing faces 22 may be modified to include some arcuate features. However, optimum results will be maintained by making the opposing faces 22 generally symmetrical with respect to any arcuate features that they may have to thereby make it easier to create a desired trapping volume.

The specific features of the first embodiment of FIG. 1 are now described as follows. The inside and opposing faces 22 have an oscillating electrical field applied thereto. The application of an oscillating field is common to all ion traps described above. The outside faces 24 have a common potential applied thereto that is a common ground in this case. However, FIGS. 3 and 4 demonstrate some other important features.

Figure 3:
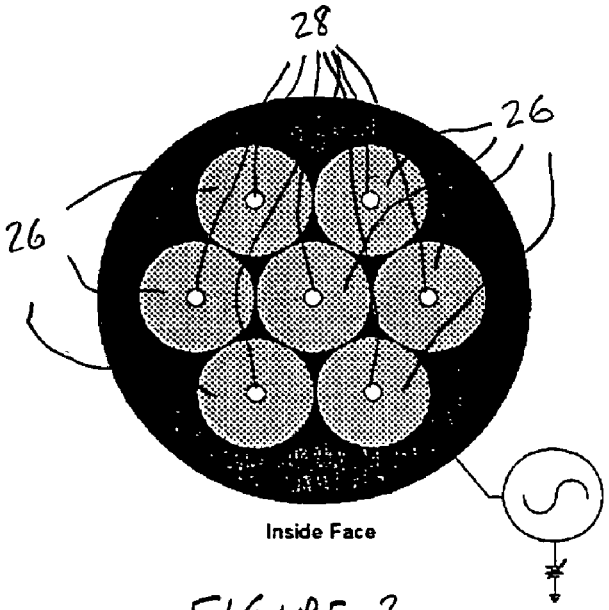
FIG. 3 is a profile view of an inside face of one of the two parallel and opposing surfaces of the first embodiment.

FIG. 3 shows that both inside faces 22 are coated with an electrically conductive material in a unique pattern so that the lattice of circular patterns 26 remains uncoated. The center of each of the circular patterns 26 has an aperture 28 disposed therethrough to the outside faces 24. The outside faces 24 and the apertures disposed through the centers of the uncoated circular patterns 26 are also coated with an electrically conductive material that is electrically isolated from the electrically conductive material on the inside faces 22.

It is also noted that the lattice of circular patterns 26 on each of the opposing faces 23 not only are disposed to face each other, but the circular patterns are also concentrically aligned.

Another observation needs to be made with respect to coatings. The term "coatings" as used in the present invention refers to conductive materials, non-conductive or insulating materials, and semi-conductive materials that can be disposed on a substrate to give selected portions of electrodes or substrates very specific electrical properties. For example, the coatings can actually function as the electrodes that are disposed on substrates to create the electrical potential field lines to generate trapping volumes.

It is also noted that although the lattice of circular patterns 26 is being used in this embodiment, alternatively the patterns can be other shapes as desired, such as squares.

When an alternating or oscillating electric field is applied to the two inside faces 22 of the virtual ion trap 20, and a constant electrical potential is applied to the outside faces 24 and apertures 28, each of the circular patterns 26 and its opposing circular pattern 26 create a trapping electrical field that can retain ions therein.

Figure 4:
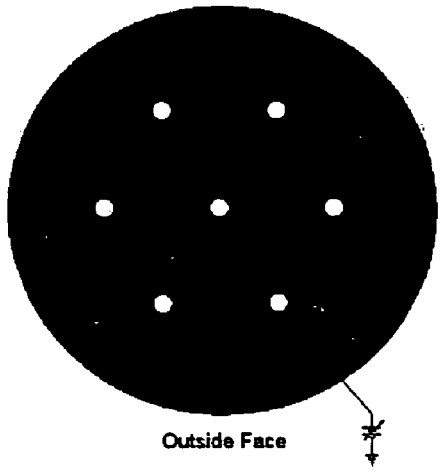
FIG. 4 is a profile view of an outside face of one of the two parallel and opposing surfaces of the first embodiment.

In the embodiment shown in FIGS. 2, 3 and 4, the trapped ions are focused toward the center of each of the circular patterns 26 between the opposing faces 22. A slowly increasing potential difference between the opposing faces 22 can be applied to create a dynamically changing electric field that selectively ejects ions out of the traps at one side or the other according to their mass-to-charge ratios.

The virtual ion trap of the present invention has several distinct and important advantages over the state of the art in ion traps. One of the most important aspects of the present invention is the high precision that can be used to construct the electrodes that are disposed on opposing faces. The state of the art relies on machined metal electrodes. The tolerances that can be achieved using machined metal parts are substantially less than the tolerances that can be achieved using photolithography.

Photolithography or any other plating technology can be used to dispose electrically conductive traces, or electrodes, on the opposing faces of a virtual ion trap. Obviously, plating techniques such as photolithography are capable of very high precision compared to machined metal parts. For example, the opposing faces 22 of FIGS. 2, 3, and 4 can be constructed on silicon wafers such as those used in the chip manufacturing industry. Obviously, very high precision is possible because of the advances in precision and reduction in size of traces as known to those skilled in the art of chip manufacturing.

Other distinct advantages of the present invention include, but are not limited to, simple fabrication, low cost, miniaturization, and mass reproducibility.

Figure 5:
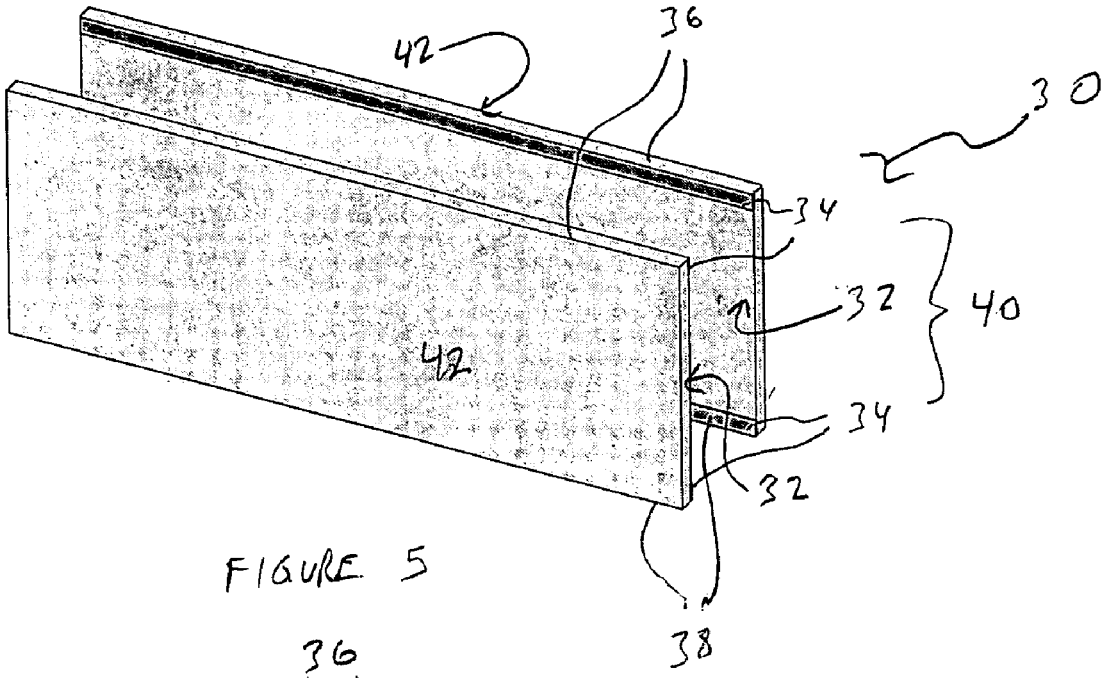
FIG. 5 is a perspective view of another embodiment of the present invention where the circular opposing faces of the virtual ion trap of FIG. 2 are now shaped as rectangles.

FIG. 5 is a perspective view of another embodiment of the present invention. FIG. 5 shows that the circular opposing faces 22 of the virtual ion trap 20 are now shaped as rectangles 32 in virtual ion trap 30. The electrodes 34 are now disposed adjacent to opposite edges 36 and 38 of the rectangular opposing faces 32. The space 40 between the electrodes 34 on the rectangular opposing faces 32 is a resistive material. The oscillating electric field is thus applied to the electrodes 34, while a constant or common mode potential voltage is applied to outside rectangular faces 42.

Alternatively, the oscillating electric field can be applied to the outside rectangular faces 42, which the common mode potential is applied to the electrodes 34.

Figure 6:
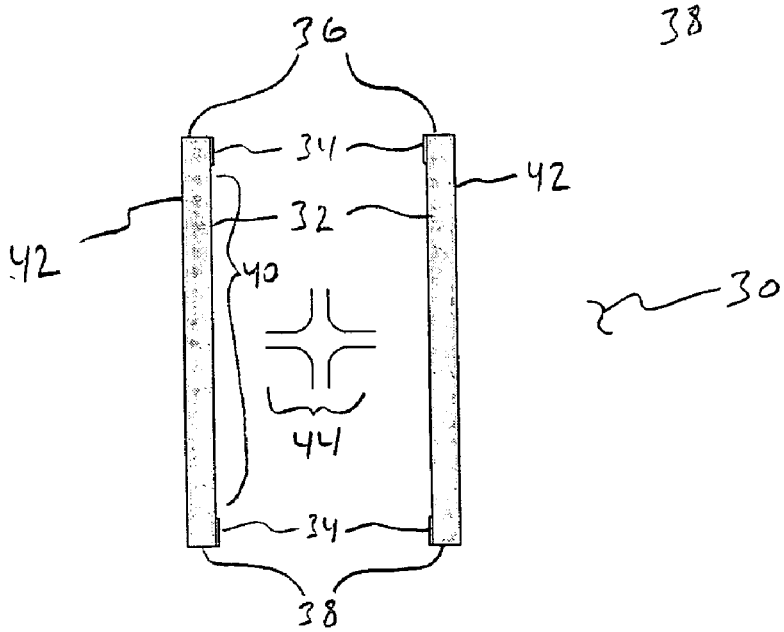
FIG. 6 is an edge-on profile view of virtual ion trap of FIG. 5.

FIG. 6 is an edge-on profile view of virtual ion trap 30. Note the position of electrodes 34. Electrical potential field lines 44 are shown at the center of the virtual ion trap 30. These electrical potential field lines 44 are only partially shown, and illustrate the orientation of the electric potential field lines with respect to each other and the rectangular opposing faces 32.

Another important advantage of the present invention is due to the ability to further shape electric potential field lines that are being generated by the present invention. Shimming is the process whereby additional electrodes are strategically disposed at ends of surfaces, plates, cylinders and other structures that are forming the virtual ion trap of the present invention. The additional electrodes are added in order to modify electrical potential field lines. By applying electrical potentials to these additional electrodes, it is possible to substantially straighten them or make them substantially parallel to each other. This action results in improved performance of the present invention because of the affect of the electrical potential field lines on the ions.

However, the affect of shimming is not confined to straightening field lines. It may be that the "idealized" field profile may have lines that are not straight or parallel. Accordingly, shimming can be performed to create a field profile that is "idealized" for any particular application, even if that application requires arcuate field lines.

In the embodiment of FIGS. 5 and 6, it is observed that shimming electrodes can be added in more than one location. For example, the shimming electrodes can be added as a vertical electrode extending between the opposite edges 36 and 38. Alternatively, the shimming electrodes can be disposed adjacent to the electrodes 34 that generate the desired electrical potential field lines that create the trapping volume. In another alternative embodiment, the electrodes 34 can even be cut so as to electrically isolated from a portion of the electrodes near the ends of the rectangular opposing faces 32.

Figure 7:
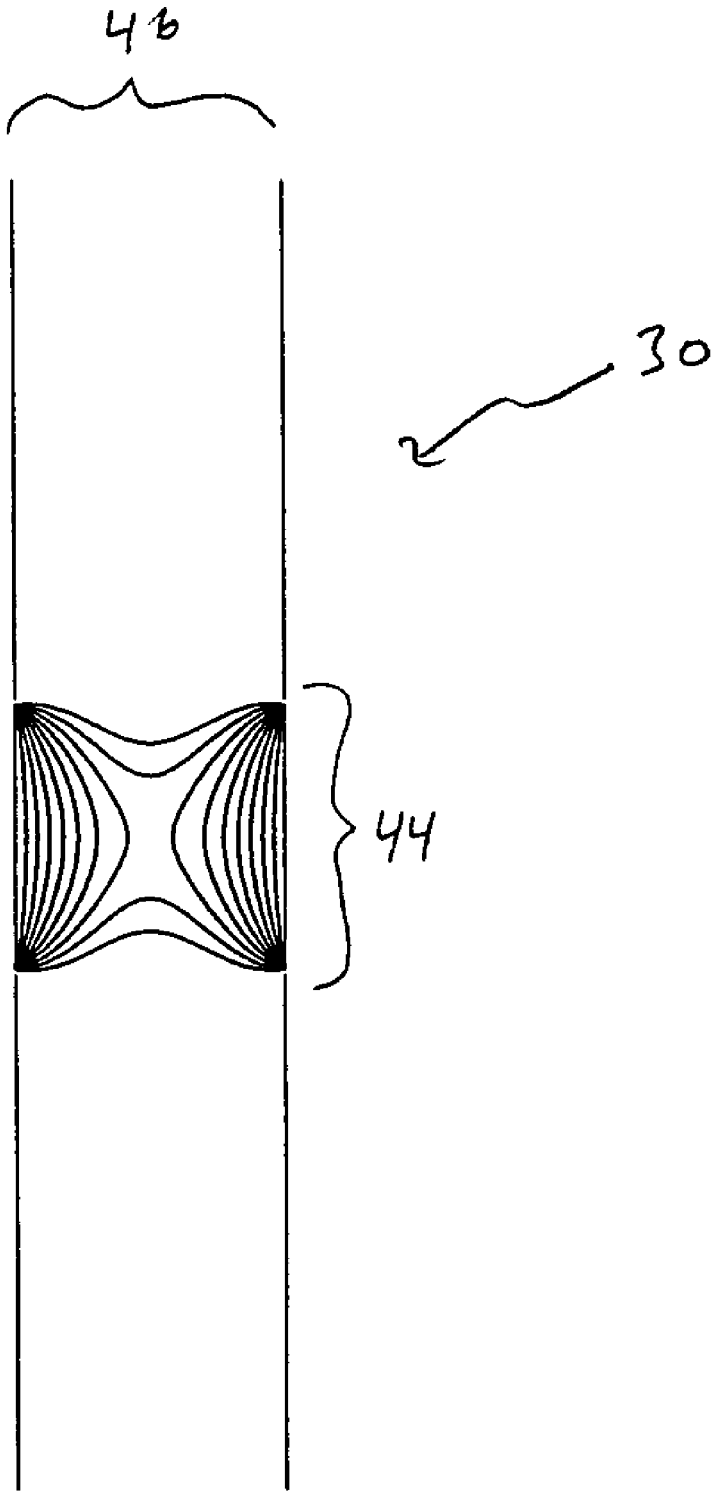
FIG. 7 is an example of a more complete illustration of the electrical potential field lines that are present in a first embodiment.

FIG. 7 is provided as only an example of a more complete illustration of the electrical potential field lines 44. Note that a gap 46 is completely open. This gap 46 enables the virtual ion trap 30 to be completely transparent to ejected ions, thereby leading to higher detection efficiency. In addition, the virtual ion trap 30 enables optical beams to penetrate the virtual ion trap to a trapping volume, to thereby enable excitation, ionization, fragmentation, or other photochemical or spectroscopic processes.

Figure 8:
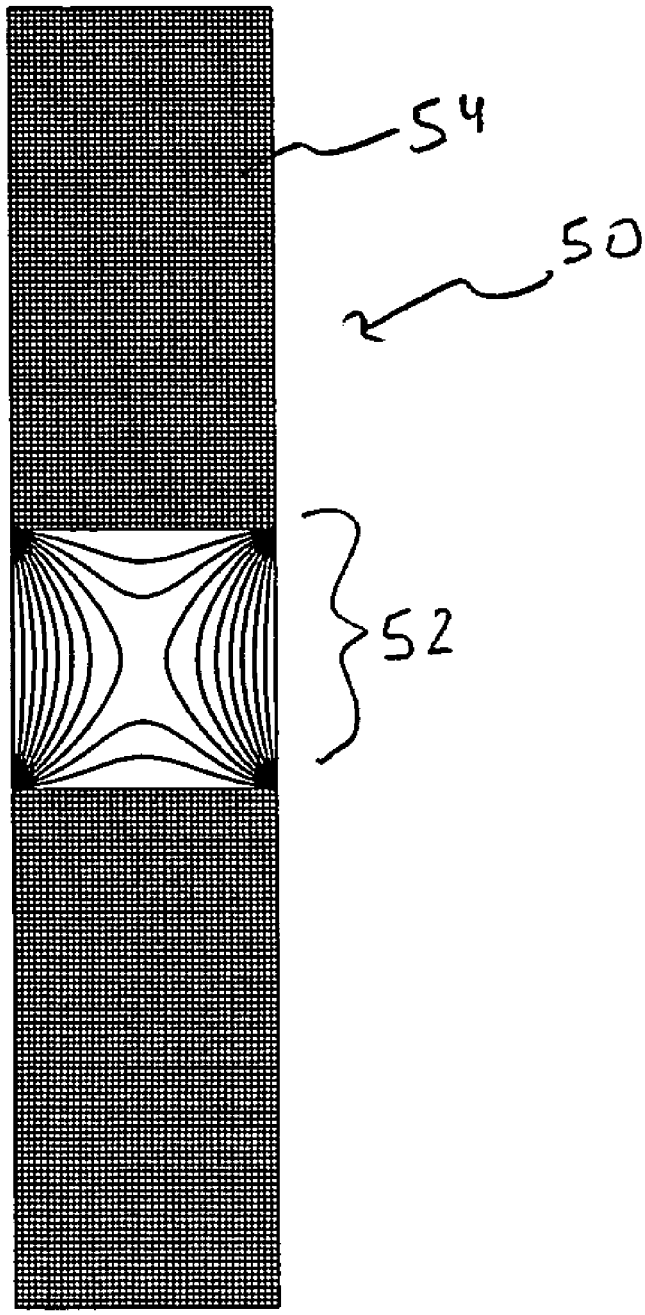
FIGURE 8 PRIOR ART
FIG. 8 is an identical illustration of electrical potential field lines that can be generated within a state of the art ion trap.

In contrast to FIG. 7, FIG. 8 illustrates an identical illustration of electrical potential field lines 52 that can be generated within a state of the art ion trap 50. However, access to a trapping volume is completely blocked by electrode or wall structure 54. Thus, the only possible access would be through some small apertures through the wall structure 54, or through perforations in an endcap (not shown).

Figure 9:
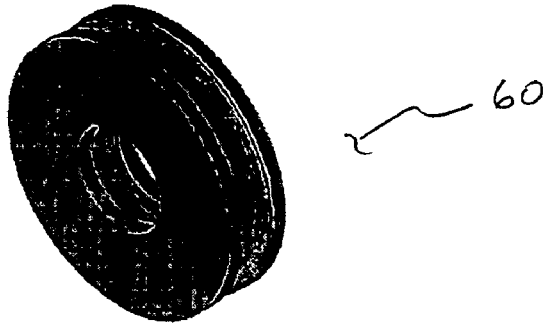
FIG. 9 is a perspective view of a planar open storage ring ion trap.

FIG. 9 is a perspective view of a planar open storage ring ion trap 60. In an alternative embodiment, the storage ring configuration can be replaced with solid disks that have no aperture through a center axis. The electrodes are disposed in the same locations.

Figure 10:
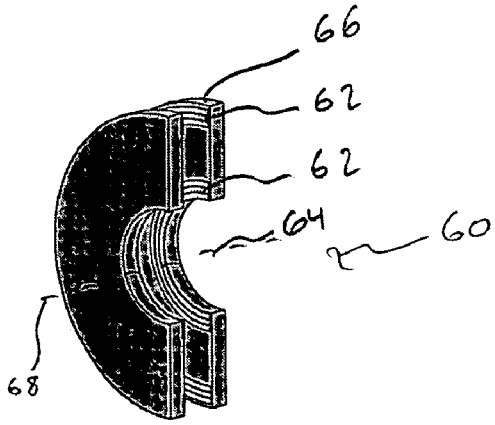
FIG. 10 is a perspective cross-sectional view of the planar open storage ring ion trap of FIG. 9.

FIG. 10 is a perspective cross-sectional view of the planar open storage ring ion trap 60 of FIG. 9. Note the electrodes 62 that are disposed adjacent to a center aperture 64 disposed coaxially around a center axis 68, and adjacent to an outer edge 66.

Figure 11:
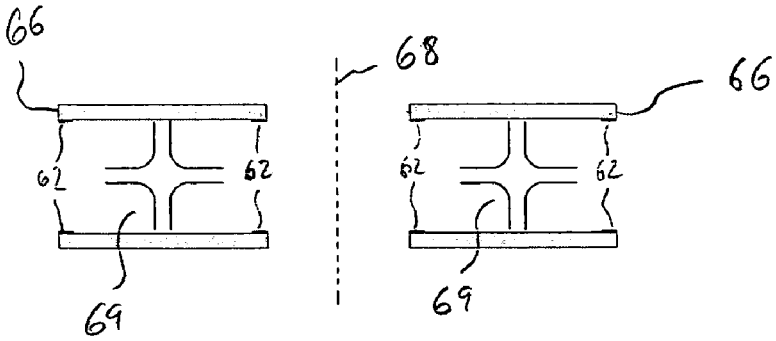
FIG. 11 is an illustration of a cross-sectional view of the planar open storage ring ion trap of FIGS. 9 and 10 that at least partially illustrates electrical potential field lines.

FIG. 11 is an illustration of a cross-sectional view of the planar open storage ring ion trap 60 of FIGS. 9 and 10 that at least partially illustrates electrical potential field lines 69.

Figure 12:
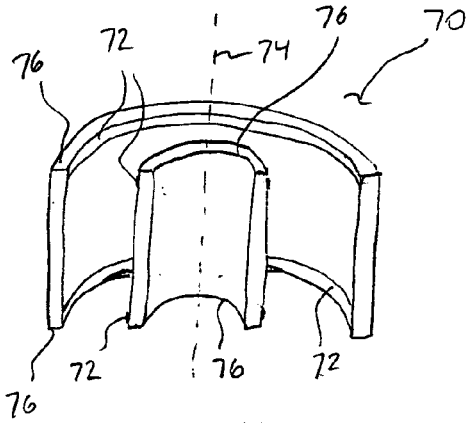
FIG. 12 is a perspective cross-sectional view of a cylindrical ion trap.

FIG. 12 is a perspective cross-sectional view of a cylindrical ion trap 70. Note that electrodes 72 are disposed adjacent to the edges 76, and disposed coaxially around a center axis 74.

Figure 13:
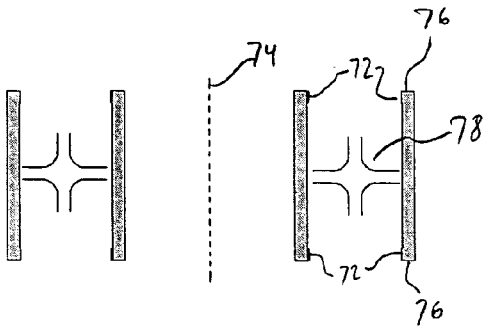
FIG. 13 is a cross-sectional and elevational view of the cylindrical ion trap of FIG. 12 that at least partially illustrates electrical potential field lines.

FIG. 13 is a cross-sectional elevational view of the cylindrical ion trap 70 that at least partially illustrates electrical potential field lines 78.

Figure 14:
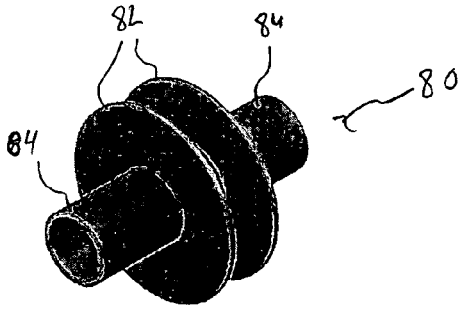
FIG. 14 is a perspective view of a plate 82 and cylinder 84 virtual ion trap.

FIG. 14 is a perspective view of a plate 82 and cylinder 84 virtual ion trap 80.

Figure 15:
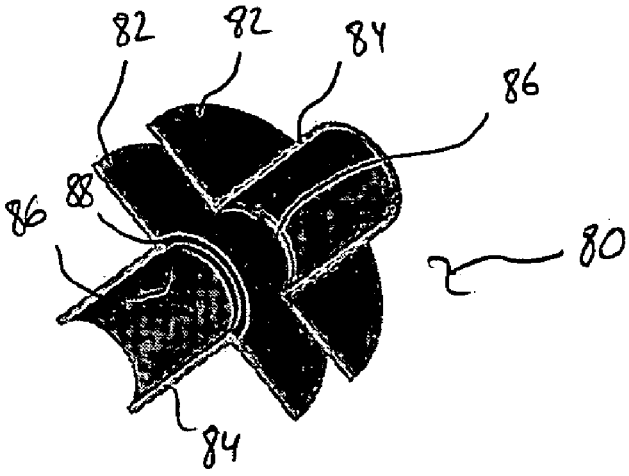
FIG. 15 is a perspective cross-sectional view of the plate and cylinder virtual ion trap shown in FIG. 14.

FIG. 15 is a perspective cross-sectional view of the plate and cylinder virtual ion trap 80 shown in FIG. 14. Note that there is an electrode 86 disposed inside the cylinders 84 and adjacent to a connection with the plates 82. Note also the electrode 88 disposed inside and on the plates 82 and adjacent to the connection with the cylinders 84.

Figure 16:
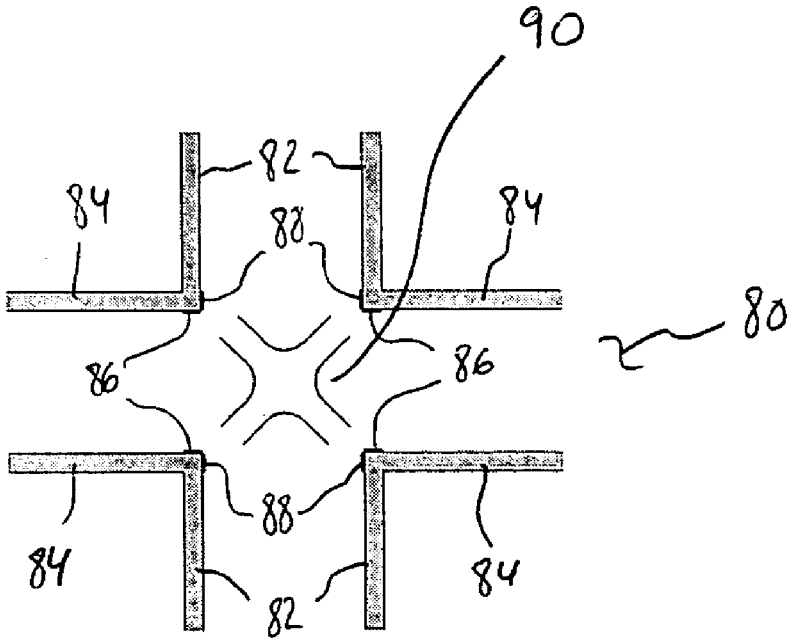
FIG. 16 is provided to illustrate the electric potential field lines that are present within the plate and cylinder virtual ion trap of FIG. 15.

FIG. 16 is provided to illustrate the electric potential field lines 90 that are present within the plate and cylinder virtual ion trap 80. It is noted that an alternative embodiment of the present invention, the view of FIG. 16 can be extended outwards from the page. In other words, the ion trap can be a linear extension of the walls 82 and 84 that are shown.

Figure 17:
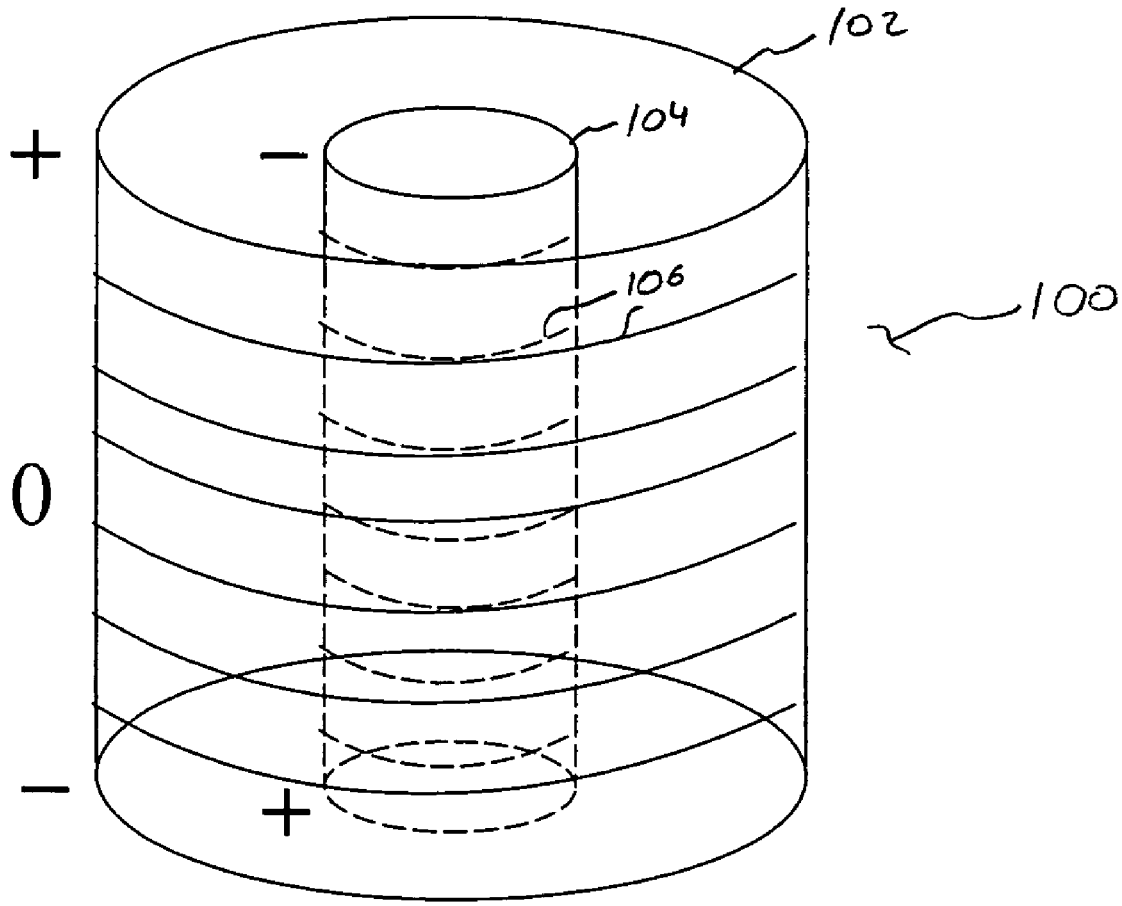
FIG. 17 is a perspective and see-through view of a cylindrical virtual ion trap.

FIG. 17 is a perspective and see-through view of a cylindrical virtual ion trap 100 wherein an outer cylinder 102 and an inner cylinder 104 have a plurality of electrodes 106 spaced apart and arranged around a circumference thereof.

Some other materials that can be used for the construction of a virtual ion trap include a leaded glass semiconductor. The leaded glass semiconductor can be polished or treated to thereby create conductive areas, and not polished or treated to leave resistive areas.

Consider also a circuit board as commonly used generally in the art of electronics. On a face side, a plurality of electrodes can be disposed as electrical traces thereon. Apertures can be used to electrically connect the electrodes via resistors on a backside of the circuit board.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A method of providing increased access to at least one trapping volume of a virtual ion trap, said method comprising the steps of:

(1) providing at least two substantially parallel surfaces of approximately the same size that are oriented so as to have opposing faces;

(2) disposing a plurality of electrodes on the opposing faces of the two substantially parallel surfaces, wherein the plurality of electrodes are disposed in an arrangement that is capable of generating a plurality of electric focusing fields between the two substantially parallel surfaces; and (3) generating the plurality of electric focusing fields using the plurality of electrodes to thereby trap ions in at least one trapping volume between the opposing faces, wherein increased access to the at least one trapping volume is made possible by the absence of any other electrodes or other structures between the two substantially parallel surfaces.

2. The method as defined in claim 1 wherein the method further comprises the step of disposing the plurality of electrodes on the two substantially parallel plates using plating techniques, to thereby obtain a high degree of precision in creating the plurality of electrodes.

3. The method as defined in claim 2 wherein the plating techniques are selected from the group of plating techniques comprised of photolithography, plating techniques for conductive materials, plating techniques for insulating materials, and plating techniques for semi-conductive materials.

4. The method as defined in claim 1 wherein the step of generating the plurality of electric focusing fields is performed by selecting a method from the group of methods comprised of applying selected voltages to the plurality of electrodes, modifying the number of the plurality of electrodes, modifying the orientation of the plurality of electrodes, modifying shapes of the plurality of electrodes, modifying properties of the plurality of electrodes, and any combination of the methods above.

5. The method as defined in claim 1 wherein the method further comprises the step of creating a plurality of trapping volumes between the two substantially parallel plates.

6. The method as defined in claim 5 wherein the step of creating the plurality of trapping volumes is performed by selecting a method from the group of methods comprised of applying selected voltages to the plurality of electrodes, modifying the number of the plurality of electrodes, modifying the orientation of the plurality of electrodes, modifying shapes of the plurality of electrodes, modifying properties of the plurality of electrodes, and any combination of the methods.

7. The method as defined in claim 1 wherein the method further comprises the step of disposing the plurality of electrodes on the at least two substantially parallel surfaces by coating the at least two substantially parallel surfaces with a conductive material, an insulating material, or a semi-conductive material.

8. The method as defined in claim 1 wherein the step of providing the two substantially parallel surfaces having the plurality of electrodes disposed thereon further comprises the step of generating virtual potential surfaces to thereby replace physical surfaces.

9. The method as defined in claim 1 wherein the step of providing two substantially parallel surfaces further comprises the step of providing two substantially parallel plates that are at least partially arcuate with respect to a common point, line, or plane.

10. The method as defined in claim 1 wherein the step of providing two substantially parallel surfaces further comprises the steps of:

(1) providing two opposing disks as the at least two substantially parallel surfaces, wherein each of the two opposing disks has an aperture disposed therethrough, the aperture being centered on a center axis of the disk, and wherein a cylinder is coupled to each disk and centered coaxially on the center axis, and wherein an edge of each aperture meets an edge of each cylinder at a connection seam;

(2) disposing a first circular electrode on each of the two opposing disks and adjacent to the connection seam; and (3) disposing a second circular electrode on each of the two cylinders adjacent to the connection seam, wherein the first electrode and the second electrode are electrically isolated from each other.

11. The method as defined in claim 1 wherein the method further comprises the steps of:

(1) providing the two substantially parallel surfaces as two identical quadrilaterals, wherein first straight electrodes are disposed opposite each other and adjacent to first edges of the two identical quadrilaterals; and (2) wherein second straight electrodes are disposed opposite each other and adjacent to second edges of the two identical quadrilaterals.

12. The method as defined in claim 11 wherein the method further comprises the step of using parallelograms as the quadrilaterals.

13. The method as defined in claim 12 wherein the method further comprises the step of selecting the two identical parallelograms from the group of parallelograms comprised of squares and rectangles.

14. The method as defined in claim 1 wherein the method further comprises the step of disposing a plurality of shimming electrodes on the two substantially parallel plates, wherein the shimming electrodes are disposed thereon to modify electrical potential field lines of the virtual ion trap.

15. The method as defined in claim 14 wherein the method further comprises the step of disposing the plurality of shimming electrodes adjacent to edges of the two substantially parallel plates.

16. The method as defined in claim 14 wherein the method further comprises the step of disposing the plurality of shimming electrodes perpendicular to the electrodes used to the first straight electrodes.

17. The method as defined in claim 14 wherein the method further comprises the step of creating the shimming electrodes from conductive or semi-conductive materials.

18. The method as defined in claim 1 wherein the method further comprises the steps of:

(1) providing the two substantially parallel surfaces as two identical and coaxially arranged disks, (2) wherein first electrodes are disposed opposite each other, adjacent to and centered about a center axis; and (3) wherein second electrodes are opposite to each other, adjacent to and centered about an outer circumference of the two substantially parallel disks.

19. The method as defined in claim 18 wherein the method further comprises the step of disposing an aperture through a center axis of the two substantially parallel surfaces.

20. The method as defined in claim 1 wherein the method further comprises the steps of:

(1) providing two opposing semicircular disks as the substantially parallel plates, wherein each of the two opposing disks has a semicircular slot cut therefrom that is centered about an axis of rotation of the semicircular disks, and wherein a half cylinder is coupled to each disk and centered coaxially on the axis of rotation, and wherein an edge of each semicircular slot meets an edge of each half cylinder at a connection point;

(2) disposing a first semicircular electrode on each of the two opposing semicircular disks and adjacent to the connection point; and (3) disposing a second semicircular electrode on each of the two half cylinders adjacent to the connection point, wherein the first electrode and the second electrode are electrically isolated from each other.

21. The method as defined in claim 1 wherein the method further comprises the steps of:

(1) disposing a plurality of patterns on the opposing faces, wherein the plurality of circular patterns have a resistive coating;

(2) disposing an aperture through a center axis of each of the plurality of patterns; and (3) coating the opposing faces with a conductive material wherever the plurality of patterns are not present, but electrically isolating the opposing faces from the apertures.

22. The method as defined in claim 21 wherein method further comprises the step of selecting the patterns from the group of patterns comprised of circles and squares.

23. The method as defined in claim 21 wherein the method further comprises the step of electrically coupling the aperture to an electrically conductive backside of each of the two substantially parallel surfaces.

24. The method as defined in claim 1 wherein the method further comprises the step of providing four sets of substantially parallel opposing surfaces, wherein the four sets of substantially parallel opposing surfaces are joined so as to form four corners of a square, wherein adjacent opposing surfaces are joined at a seam that is orthogonal thereto.

* * * * *